US008881739B2

(12) United States Patent
Kim et al.

(10) Patent No.: US 8,881,739 B2
(45) Date of Patent: Nov. 11, 2014

(54) CURLING IRON HAVING PROTRUDING AND RETRACTING COMB TEETH

(75) Inventors: Sang An Kim, Incheon (KR); Jin-Ho Choi, Dongducheon-si (KR)

(73) Assignee: Haejeong Min, Dongducheon-Si (KR)

( * ) Notice: Subject to any disclaimer, the term of this patent is extended or adjusted under 35 U.S.C. 154(b) by 130 days.

(21) Appl. No.: 13/615,769

(22) Filed: Sep. 14, 2012

(65) Prior Publication Data

US 2013/0263882 A1 Oct. 10, 2013

(30) Foreign Application Priority Data

Apr. 6, 2012 (KR) ..... 10-2012-0036013

(51) Int. Cl.
*A45D 1/18* (2006.01)
*A45D 1/04* (2006.01)
*A46B 9/10* (2006.01)

(52) U.S. Cl.
CPC ... *A45D 1/18* (2013.01); *A46B 9/10* (2013.01); *A45D 1/04* (2013.01)
USPC ..... 132/118; 132/123

(58) Field of Classification Search
CPC ..... A45D 2/42; A45D 1/18; A45D 2/24; A45D 4/12; A45D 1/04; A45D 2/367; A45D 4/18; A46B 7/023; A46B 2200/104; A46B 17/06; A46B 9/10
USPC ..... 132/123, 229, 269; 15/169, 184, 203, 15/119, 120
See application file for complete search history.

(56) References Cited

U.S. PATENT DOCUMENTS

| | | | | |
|---|---|---|---|---|
| 2,244,068 | A * | 6/1941 | Constantine | 132/123 |
| 3,150,393 | A * | 9/1964 | Crookes et al. | 15/23 |
| 4,191,200 | A * | 3/1980 | Renda | 132/123 |
| 4,335,732 | A * | 6/1982 | Megna | 132/123 |
| 4,492,241 | A * | 1/1985 | Thaler et al. | 132/229 |
| 2002/0078971 | A1 * | 6/2002 | Anderson | 132/123 |

* cited by examiner

*Primary Examiner* — Robyn Doan
(74) *Attorney, Agent, or Firm* — Sughrue Mion, PLLC

(57) ABSTRACT

A hair curling apparatus in which comb teeth protrude and retract includes an electro thermal line heater mounted within a cylindrical body to provide heat, comb teeth configured to protrude from the body to comb and wind hair, a cap and a handle in a front portion and a rear portion of the body, a shaft installed substantially at a center inside the body, a lever coupled to the handle, wherein the shaft is moved forward or backward when the lever is pushed or pulled, a link connected to the shaft through a pin, and a support connected to the link through the pin, wherein the support is raised or lowered in an upper or lower portion of the shaft, and the comb teeth protrudes or retracts through holes formed by perforating the cylindrical body.

6 Claims, 11 Drawing Sheets

CURLING IRON HAVING PROTRUDING AND RETRACTING COMB TEETH

PRIORITY

This application claims the benefit under 35 U.S.C. §119 a of a Korean patent application filed in the Korean Intellectual Property Office on Apr. 6, 2012 and assigned Ser. No. 10-2012-0036013, and the entire disclosure of which is hereby incorporated by reference.

BACKGROUND OF THE INVENTION

1. Field of the Invention

The present invention relates to a hair iron in which comb teeth protrude and retract, and more particularly, to a hair iron in which comb teeth protrude and retract from a brush body such that hair curling is very convenient and prompt, thereby increasing work efficiency.

2. Description of the Related Art

Generally, a hair curling apparatus applies heat to hair while winding and unwinding the hair to produce a wave in the hair, drying, and styling the hair. Various forms of hair curling instruments are used for the hair curling apparatus.

Among these, a hair curling apparatus, which uses a brush body having comb teeth formed thereon to brush, tidy, and wind the hair, is a hair curling instrument that is widely used because it does not require a separate brush for combing the hair.

When the comb teeth are formed on the brush body, an operation of combing, arranging, winding, and setting the hair is convenient, however, when unwinding the hair from the brush body, the hair is stuck to the comb teeth, and thus, an operation of separating the brush body is very inconvenient.

Particularly, during a process of winding and unwinding the hair, hair is tangled in the comb teeth such that a curling operation becomes a difficult and long process.

Thus, when the hair is wound around the brush body, the brush body cannot be pulled and separated from the hair, and therefore, the wound hair needs to be unwound entirely from the brush body in order to separate the brush body. Accordingly, a shape of the hair set by curling is changed such that the hair may not be styled with a desired wave.

SUMMARY OF THE INVENTION

Accordingly, the present invention has been made in view of the above problems, and the present invention is to provide a hair iron capable of arranging and winding hair easily and separating a brush body quickly and conveniently without destroying hair curls.

In one aspect of the present invention, provided is a hair curling apparatus in which comb teeth protrude and retract, the hair curling apparatus including an electro thermal line heater mounted within a cylindrical body to provide heat; comb teeth configured to protrude from the body to comb and wind hair; a cap; a handle coupled to the cap in a front portion and a rear portion of the body; a shaft installed substantially at a center inside the body; a lever coupled to the handle, wherein the shaft is moved forward or backward when the lever is pushed or pulled; a link connected to the shaft through a pin; and a support connected to the link through the pin, wherein the support is raised or lowered in an upper or lower portion of the shaft, and the comb teeth protrudes or retracts through holes formed by perforating the cylindrical body.

As described above, according to the present invention, when a lever of a handle is pushed, a link is erected vertically such that teeth, along with a support, is raised to protrude through a hole to enable a styling operation which combs and arranges hair and produces a wave. Also, when the lever is pulled, the link is slidably folded such that the comb teeth, along with the support, are lowered and received inside the body and the comb teeth are completely separated from the hair, thereby conveniently separating the hair by pulling the body. Thus, through a simple operation of pushing and pulling the lever, the comb teeth protrude through the hole of the body, a hair curling operation may become easy and prompt to increase convenience in use, and a hair iron in which teeth protrude and retract to have high performance and superior competitiveness may be provided.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Figure 1:
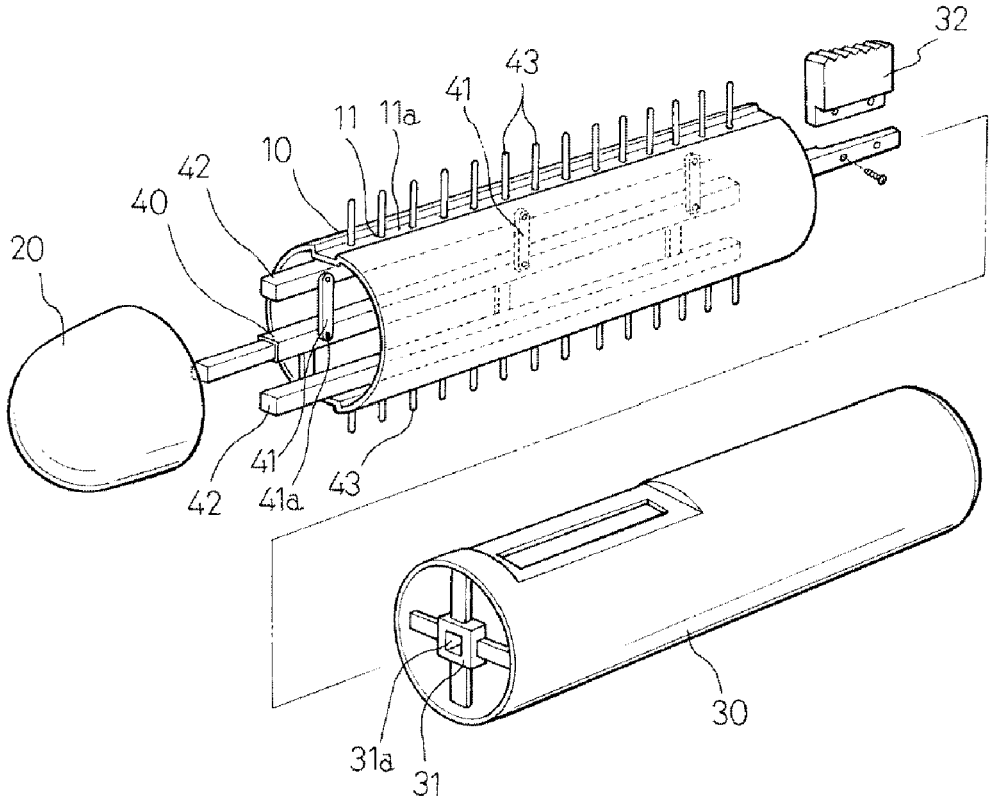
FIG. 1 is an exploded perspective view illustrating a hair curling apparatus according to an exemplary embodiment of the present invention.

The invention now will be described more fully hereinafter with reference to accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Furthermore, relative terms such as "lower" or "bottom" and "upper" or "top" may be used herein to describe one element's relationship to another element as illustrated in the figures. It will be understood that relative terms are intended to encompass different orientations of the device in addition to the orientation depicted in the figures. For example, if the device in the figures is turned over, elements described as being on the "lower" side of other elements would then be oriented on "upper" sides of the other elements. The exemplary term "lower," can therefore encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Exemplary embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present invention.

Hereinafter, the present invention will be described in detail with reference to the accompanying drawings.

As shown in FIGS. 1 through 7*b*, a heater 12 with an electro thermal line is positioned in both sides inside a body 10, which is formed in a cylindrical metal tube, and the cylindrical body 10 provides heat by using the heater 12.

Comb teeth 43 are protrudingly provided on the body 10 such that hair can be combed and wound around the body 10. A cap 20 and a handle 30 are respectively coupled to a front portion and a rear portion of the body 10.

It should be noted that a hair curling apparatus having the above described configuration is already known in the art.

However, the present invention is characterized in that the comb teeth 43 which are protrudingly provided on the body 10 protrude and retract from the brush body 10 such that the brush body 10 can be separated easily and conveniently.

In other words, a shaft 40 is mounted substantially at a center inside the body 10 and the shaft 40 is connected with a lever 32, which is coupled to the handle 30. When the lever 32 is pushed or pulled, the shaft 40 is moved forward or backward.

The shaft 40 is connected to a link 41 through a pin 41*a* and a support 42 is connected to the link 41 through the pin 41*a*.

The support 42 is mounted above and below the shaft 40 and connected to the link 41. When the shaft 40 is moved forward or backward, the upper support 42 and the lower support 42 are respectively raised or lowered.

The comb teeth 43 are formed on the support 42 and the comb teeth 43 enter or exit through holes 11 that are respectively perforated on the upper and lower portions of the cylindrical body 10.

Figure 2A:
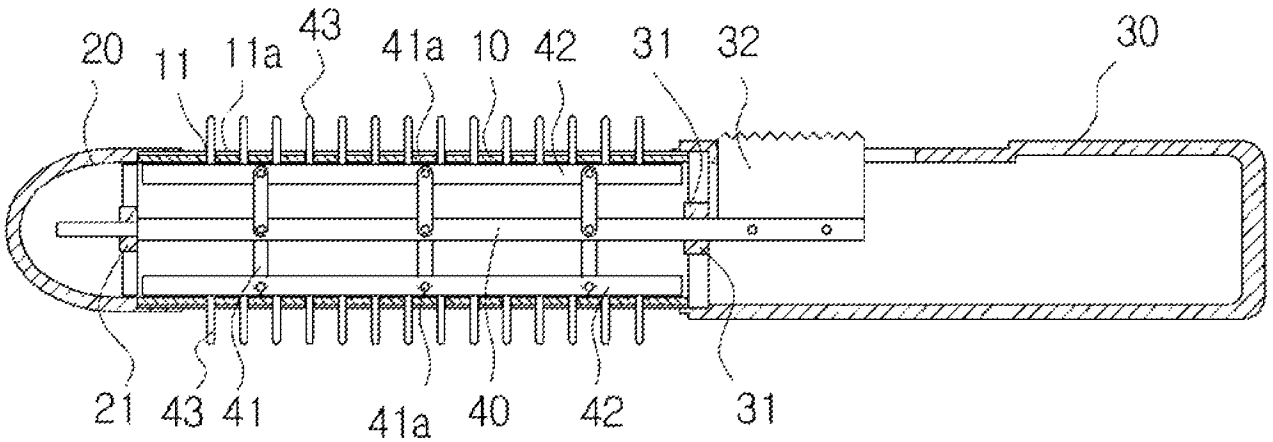
FIGS. 2*a* and 2*b* are front cross sectional views illustrating an operational state of a hair curling apparatus according to an exemplary embodiment of the present invention.
Figure 4A:
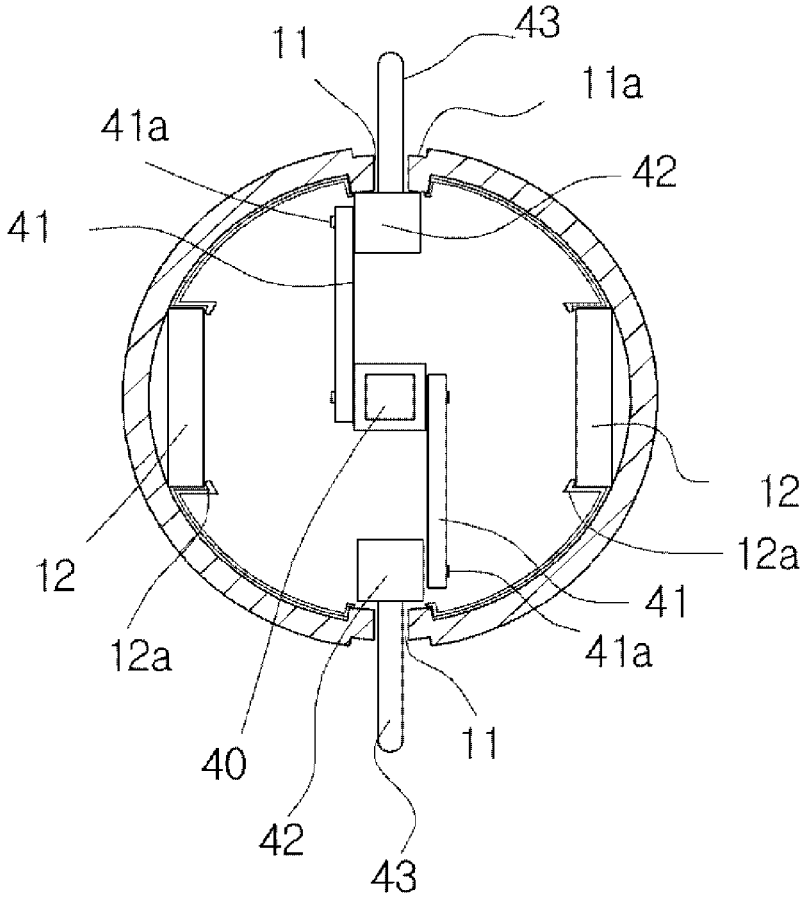
FIGS. 4*a* and 4*b* are side cross sectional views illustrating an operational state of a hair curling apparatus according to the present invention.

In the present invention having the above configuration, as shown in FIG. 2*a* and FIG. 4*a*, when the links 41 are vertically erected on the shaft 40, the support 42 is raised (or moved forward) such that the comb teeth 43 are protruded through the hole 11, thereby enabling combing or arranging the hair and winding the hair around the body 10.

Figure 2B:
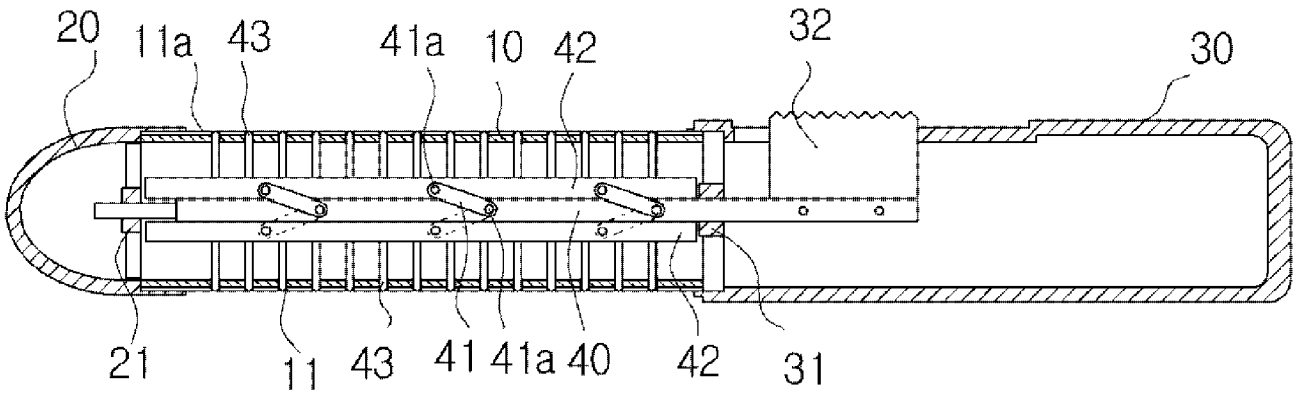
Figure 3:
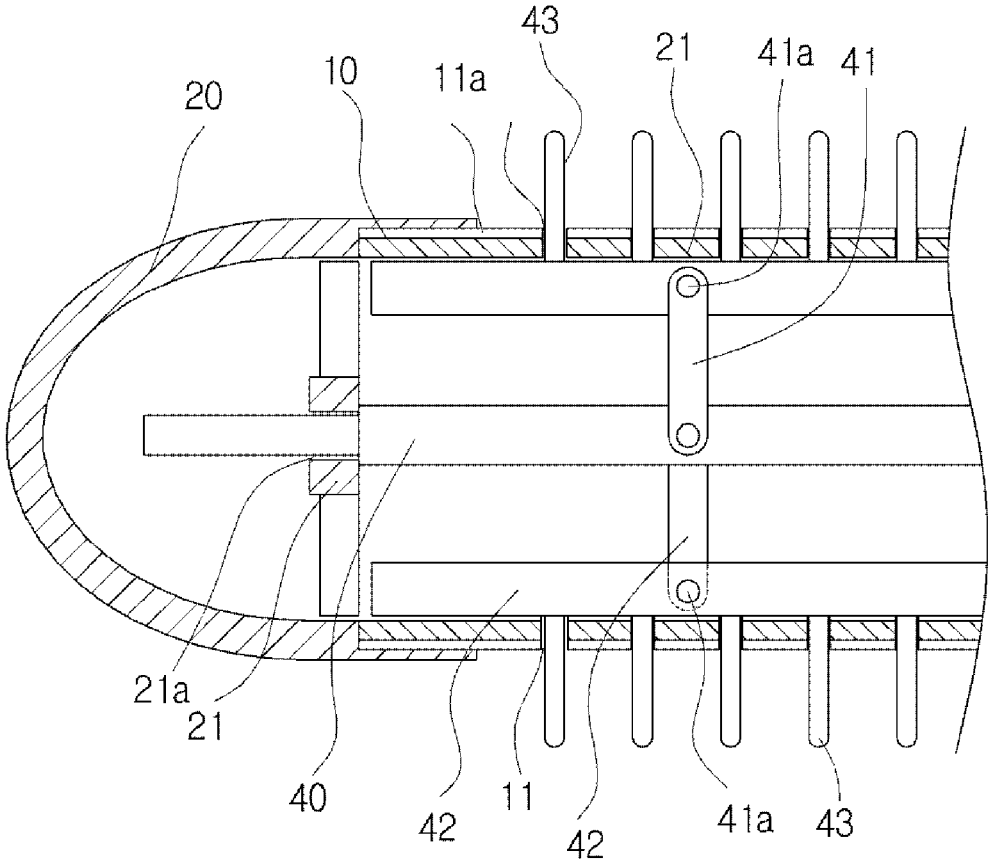
FIG. 3 is an enlarged cross sectional view illustrating a portion of the hair curling apparatus of FIG. 2*a;*
Figure 4B:
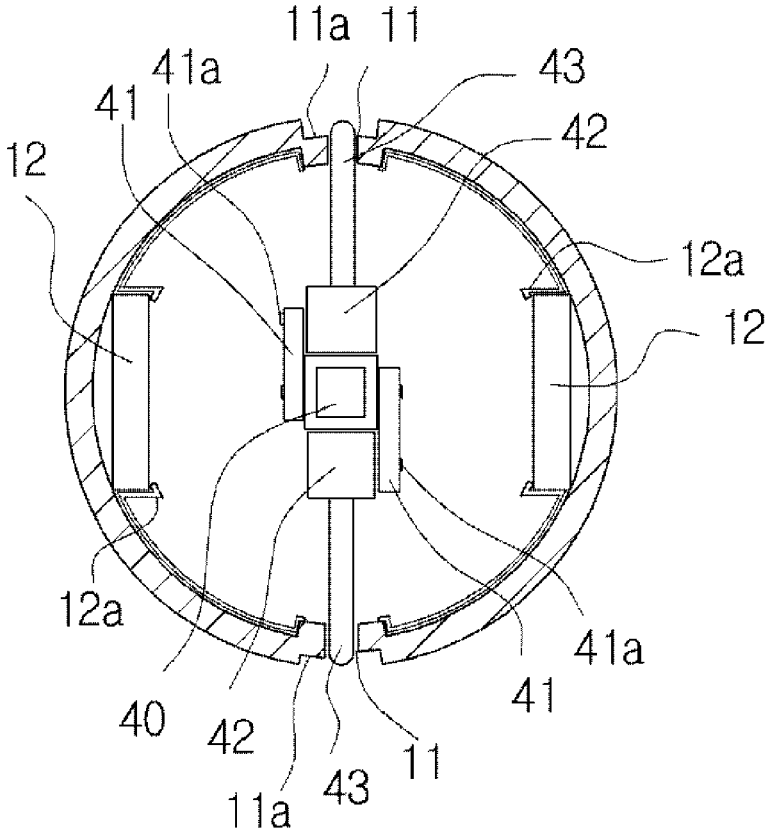

On the other hand, when the lever 32 of the handle 30 is pulled, as shown in FIG. 2*b* and FIG. 4*b*, the shaft 40 is moved backward such that the link 41 is slidably folded to lower (or move backward) the support 42 and the comb teeth 43 are lowered to be received inside the body 10 through the hole 11. Thus, when the cylindrical body 10 on which the hair is wound is pulled, the comb teeth 43 may not be stuck in the hair such that separation of the body 10 becomes easy and convenient.

Also, when the lever 32 is pushed where the hair is separated from the body 10, the link 41 is again vertically erected such that the comb teeth 43 are protruded through the hole 11, thereby enabling curling the hair to produce a wave. Thus, through a simple operation of pushing and pulling the lever 32, the comb teeth 43 may protrude or retract through the hole of the body 10, thereby performing a curling operation easily.

Guides 31, 21 are formed substantially at a center of the handle 30 and the cap 20, respectively, and the shaft 40 is coupled through a guide hole 21*a* of the guides 31 and 21 such that forward or backward movement of the shaft 40 is performed while being stably supported by the guides 31 and 21. Thus, the movement of the shaft 40 and the raising or lowering operation of the support 42 may be performed accurately.

A guide groove 11*a* is formed on the upper and lower portions of the cylindrical body 10 and the holes 11 are formed on the guide groove 11*a*, and an upper portion of the comb teeth 43 is configured not to be exposed to an upper portion of the guide groove 11*a* when the comb teeth 43 is lowered.

Therefore, even when the comb teeth 43 is not completely lowered such that the upper portion of the comb teeth 43 is slightly protruded through the hole 11, the upper portion of the comb teeth 43 is still positioned within the guide groove 11*a*, thereby avoiding a problem that the hair wound around the body 10 is stuck in the comb teeth 43.

Reference number 12*a* refers to a plate spring for fixing the heater 12 mounted inside the body 10.

As described above, the shaft 40 is operated by pushing or pulling the lever 32. Alternatively, the shaft 40 may be automatically operated by using a vibration motor 50.

Figure 5A:
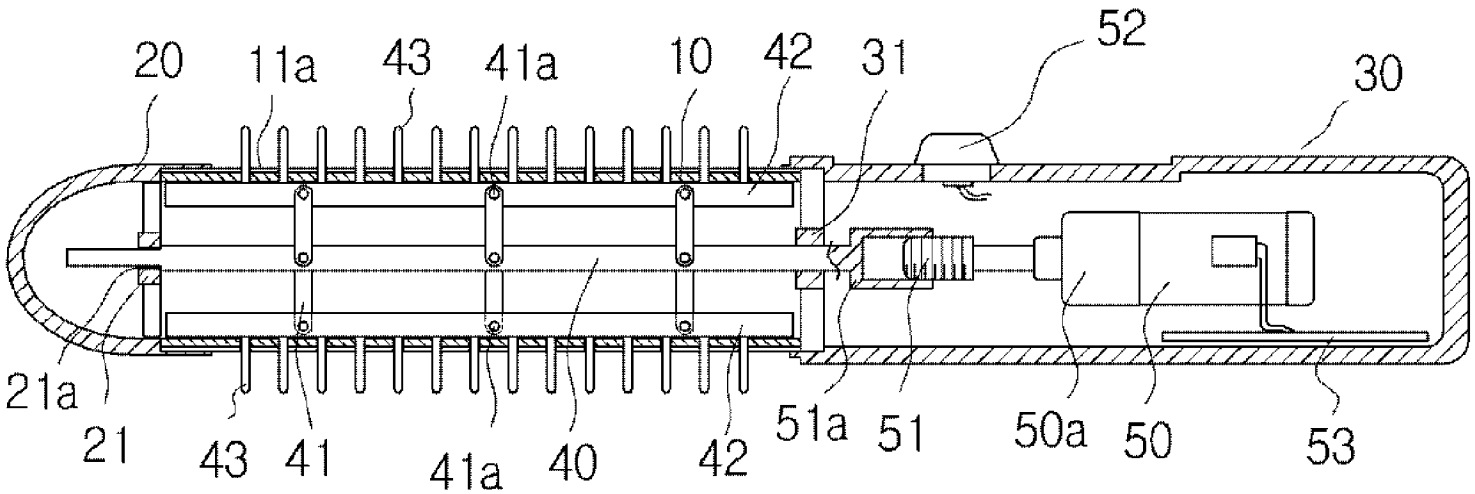
FIGS. 5*a* and 5*b* are front cross sectional views illustrating a hair curling apparatus according to another exemplary embodiment of the present invention.
Figure 5B:
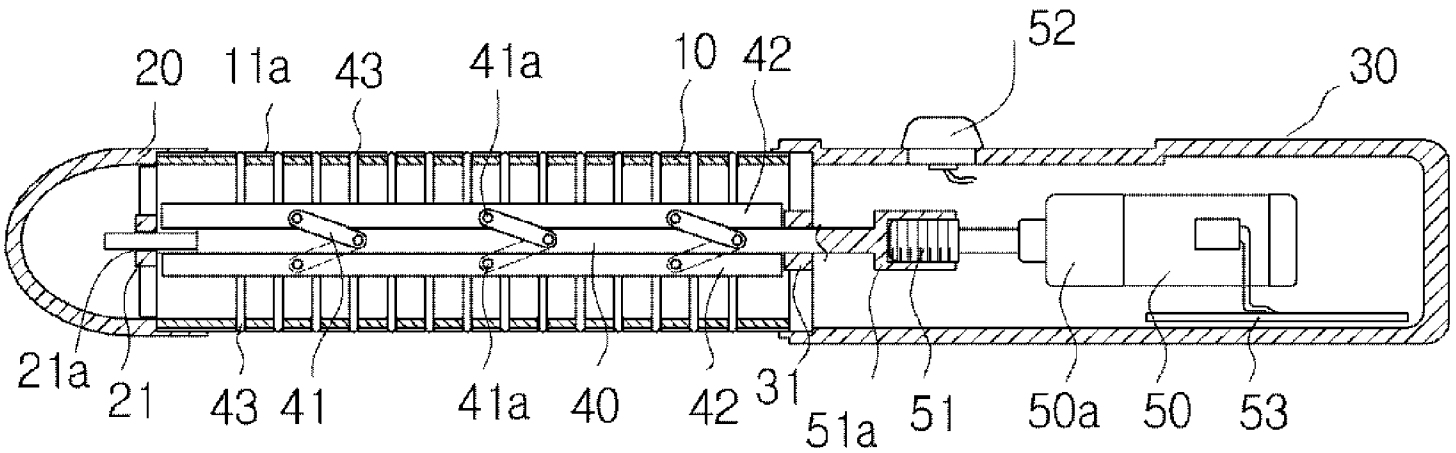

In other words, as shown in FIGS. 5*a* and 5*b*, the motor 50 is mounted within the handle 30 and a bolt 51, which is fixed on a rotational axis of the motor 50, is screw-coupled to a nut 51*a*, which is fixed on a rear portion of the shaft 40. Thus, when rotating or reverse rotating the motor 50, the shaft 40 as well as the nut 51*a* coupled to the bolt 51 may be moved forward or backward.

Therefore, by turning on a switch 52 provided on the handle 30, the motor 50 is rotated or reversely rotated to automatically move the shaft 40 such that the comb teeth 43 may protrude or retract, thereby increasing convenience in use.

It should be noted that an electromagnetic apparatus such as a solenoid may be used instead of the motor to move the shaft 40. Thus, the present invention is not limited to a motor driving method.

Oh the other hand, it is described in the above that two lines of the comb teeth 43 are respectively formed on the upper and lower portions of the body 10. However, the comb teeth 43 may be formed in a radial form in 6-8 lines on the body 10 such that the hair may be combed more tidily and winding the hair may be performed more efficiently.

Figure 6:
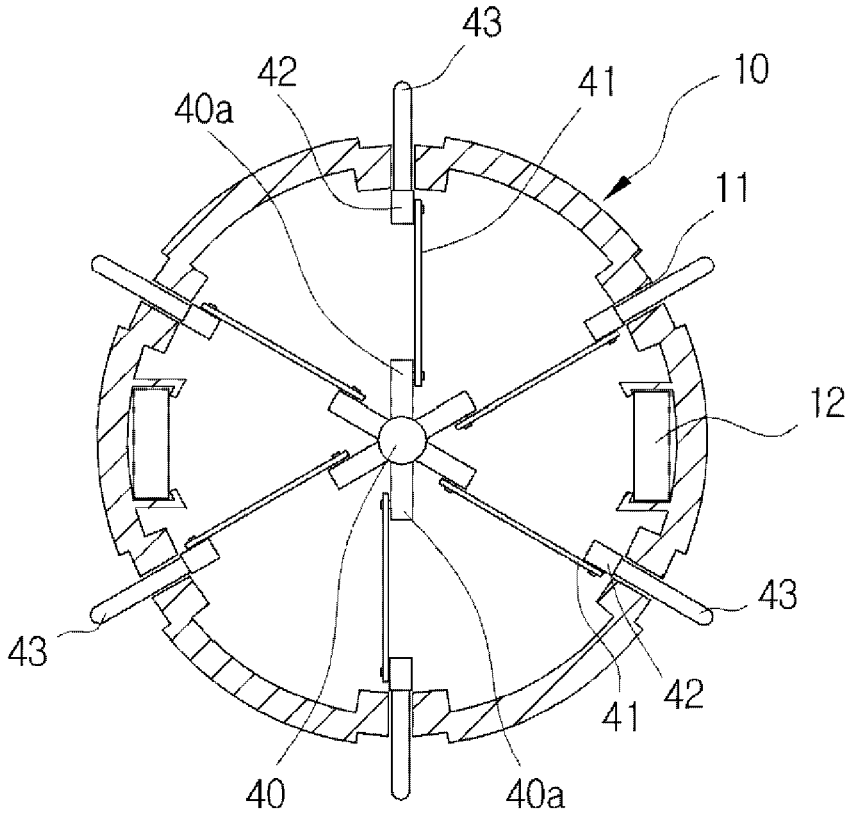
FIG. 6 is a side cross sectional view illustrating a hair curling apparatus according to another exemplary embodiment of the present invention.
Figure 7A:
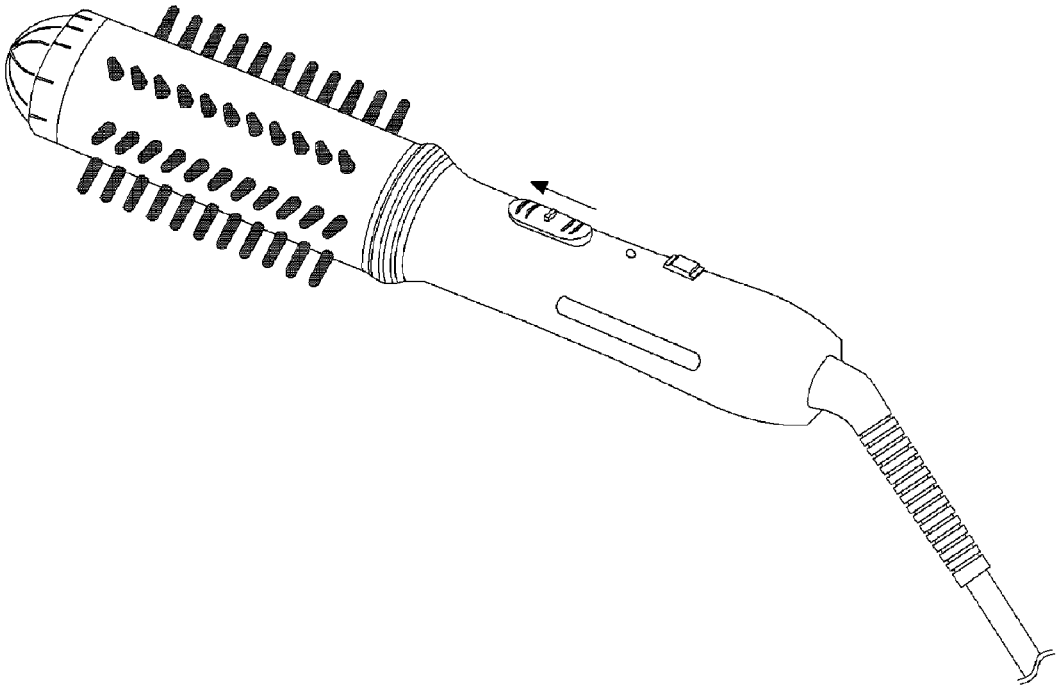
FIGS. 7*a* and 7*b* are perspective views of an operational state of a hair curling apparatus according to an exemplary embodiment of the present invention.
Figure 7B:
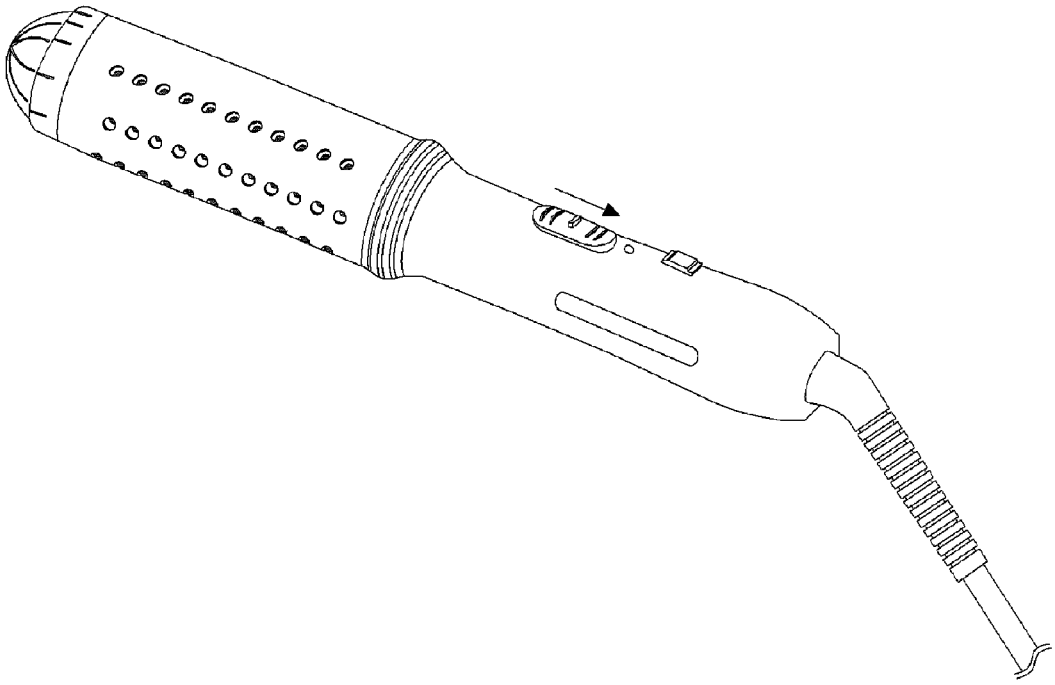

In other words, as shown in FIG. 6, a plurality of supports 40*a* are formed on the shaft 40 to protrude in a radial shape and the comb teeth 43 are penetratingly coupled to the body 10. The links 41 are respectively coupled between the support 42 of the comb teeth 43 and the support 40*a* of the shaft 40 by using the pin 41*a* such that, when the lever 32 of the shaft 40 is pushed, the comb teeth 43 in 6-8 lines may protrude from the body 10 in the radial shape.

Reference number 50*a* refers to a decelerator for controlling a rotation speed of the motor 50 and reference number 53 refers to a printed circuit board (PCB) on which a circuit for controlling rotation and reverse rotation of the motor 50 according to a signal from the switch 52 is designed.

In the above, although the embodiments of the present invention have been described with reference to the accompanying drawings, a person skilled in the art should apprehend that the present invention can be embodied in other specific forms without departing from the technical spirit or essential characteristics thereof. Thus, the embodiments described above should be construed as exemplary in every aspect and not limiting.

<DESCRIPTION OF REFERENCE NUMBER>

| | |
|---|---|
| 10: body | 11: hole |
| 11a: guide groove | 12: heater |
| 12a: spring | 20: cap |
| 21, 31: guide | 21a, 31a: guide hole |
| 30: handle | 32: lever |
| 40: shaft | 40a: support |
| 41: link | 41a: pin |
| 42: support | 43: comb teeth |
| 50: motor | 50a: decelerator |
| 51: bolt | 51a: nut |
| 52: switch | 53: PCB |

What is claimed is:

1. A hair curling apparatus in which comb teeth protrude and retract, the hair curling apparatus comprising:

an electro thermal line heater mounted within a cylindrical body to provide heat;

comb teeth configured to protrude from the body to comb and wind hair;

a cap coupled to a front portion of the body;

a handle coupled to a rear portion of the body;

a shaft installed substantially at a center inside the body;

a lever coupled to the handle, wherein the shaft is moved forward or backward when the lever is pushed or pulled;

a link connected to the shaft through a first pin;

a first support configured to extend substantially parallel to the shaft and connected to the link through a second pin; and a second support configured to extend substantially parallel to the shaft and connected to the link through a third pin, wherein the comb teeth are provided on each of the first support and the second support, wherein, the first or second support is raised or lowered in an upper or lower portion of the shaft, and the comb teeth protrude or retract through holes formed by perforating the cylindrical body.

2. The hair curling apparatus according to claim 1, wherein the handle and the cap respectively comprise guides at a center portion thereof, and wherein the shaft is moved through a guide hole of the guides when the shaft is moved forward or backward.

3. The hair curling apparatus according to claim 1, wherein a motor is mounted within the handle, and a bolt, which is fixed on a rotation axis of the motor, is screw coupled to a nut, which is fixed on a rear portion of the shaft such that the shaft is moved forward or backward by rotating or reverse rotating the motor.

4. The hair curling apparatus according to claim 1, wherein a plurality of supports are protrudingly formed on the shaft in a radial form, the comb teeth are penetratingly coupled to the body, and links are coupled between a support of the comb teeth and a support of the shaft through the first pin such that the comb teeth protrude or retract from the body in the radial shape when the shaft is pushed or pulled.

5. The hair curling apparatus according to claim 1, further comprising:

a spring configured to fix the electro thermal line heater mounted within the cylindrical body, at least a portion of the spring being attached to an inner surface of the cylindrical body.

6. The hair curling apparatus according to claim 1, wherein the body comprises:

a guide groove formed on top and bottom portions of the body such that a first step is formed between the guide groove and the cap and a second step is formed between the guide groove and the handle, wherein the through holes are formed on the guide groove.

* * * * *